US007704091B2

(12) United States Patent
Millan

(10) Patent No.: US 7,704,091 B2
(45) Date of Patent: Apr. 27, 2010

(54) SNAGLESS PLUG AND BOOT CONNECTION

(76) Inventor: Henry Millan, 2714 Ashburton Ct., Rochester, MI (US) 48306

( * ) Notice: Subject to any disclaimer, the term of this patent is extended or adjusted under 35 U.S.C. 154(b) by 0 days.

(21) Appl. No.: 12/246,351

(22) Filed: Oct. 6, 2008

(65) Prior Publication Data

US 2009/0117772 A1 May 7, 2009

Related U.S. Application Data

(60) Provisional application No. 60/977,413, filed on Oct. 4, 2007.

(51) Int. Cl.
*H01R 4/50* (2006.01)
*H01R 13/625* (2006.01)

(52) U.S. Cl. ..... 439/344; 439/354

(58) Field of Classification Search ..... 439/353, 439/344, 347, 354; D13/147, 156
See application file for complete search history.

(56) References Cited

U.S. PATENT DOCUMENTS 5,685,736 A * 11/1997 Lung ..... 439/447
6,254,418 B1 * 7/2001 Tharp et al. ..... 439/352
6,322,386 B1 * 11/2001 Tharp et al. ..... 439/344
6,866,532 B1 * 3/2005 Huang ..... 439/344
7,101,212 B1 * 9/2006 Larkin ..... 439/344

* cited by examiner

*Primary Examiner*—Hae Moon Hyeon
(74) *Attorney, Agent, or Firm*—Butzel Long

(57) ABSTRACT

A boot for supporting a plug connected to a cable, the plug including a flexible tab attached thereto and comprising a housing having a front opening for accommodating the plug and an opposite back opening for receiving the cable and allowing the cable to pass therethrough to the plug, a recess formed in the housing; and a tab protector engaged with the recess for engaging the flexible tab of the plug.

9 Claims, 4 Drawing Sheets

SNAGLESS PLUG AND BOOT CONNECTION

CROSS-REFERENCE TO RELATED PATENT APPLICATIONS

This application claims the benefit of U.S. Provisional Patent Application No. 60/977,413, filed Oct. 4, 2007, the specification of which is incorporated herein by reference.

BACKGROUND OF THE INVENTION

The present invention relates generally to electrical connections and cable assemblies such as those used for telecommunications and data transfer and more specifically to snagless boots for electrical connectors commonly used for telephonic and data cables.

Communications cables commonly use a plug 10 attached to the end of a cable 12 as shown in FIG. 1 to make an electrical connection with a device (not shown) such as a computer or telephone or another type of receptacle. The plug 10 is shaped so as to be received by and held in an appropriate receptacle (not shown) in the device. The plug 10 typically consists of a main body portion 14 that is at least partially received by the receptacle. The plug 10 typically further includes a tab 16 extending angularly from the main body portion 14 such that when the plug 10 is inserted into the receptacle, the tab 16 is urged closer to the main body portion 14 of the plug 10. The receptacle and plug 10 are designed such that upon inserting the plug 10 a predetermined distance into the receptacle, the tab 16 "locks" with the receptacle thereby releasably securing the plug in the receptacle such that an electrical connection can be maintained and the plug 10 will not slide out of the receptacle. In order to remove the plug 10 from the receptacle, the tab 16 is typically squeezed closer to the main body portion 14 which then allows the plug 10 to be slid out from the receptacle. The mechanisms described above are well known in the art and commonly used for telephone connections and computer/data connections.

While the tab 16 is useful for holding the plug 10 in the receptacle and thereby ensuring that an electrical connection is maintained, the tab 16 is typically a very thin piece of plastic and is often unintentionally snapped off of the main body portion 14 of the plug 10. This may occur from repeated insertion and removal from receptacles or even when the cable 12 is run and pulled through walls, behind furniture, and other activities involved when connecting devices. In these situations, the tab 16 often catches or "snags" objects causing the tab 16 to break off of the plug 10.

There have been a number of approaches to eliminate or lessen the chances of the tab 16 snagging an object or obstacle and becoming damaged as a result. Two of the most common approaches are shown in FIGS. 2 and 3. FIG. 2 shows a flexible boot 20 for protecting the connection of the plug 10 to the cable 12 and provides a hood 22 for covering the extended end of the tab 16 so as to prevent the tab 16 from snagging on objects. Since the boot 20 is flexible, the hood 22 still allows for the tab 16 to be pressed closer to the main body portion 14 in order to disengage the plug 10 from a receptacle. However, the hood 22 must be rigid enough to be able to protect the tab and as a result many users find the hood too rigid to easily facilitate unlocking the plug from the receptacle.

FIG. 3 shows a boot 30 having two wings 32 on either side of the tab 16 instead of the hood 22 shown in FIG. 2. The wings 32 are shaped and sized so as to prevent many different types of snags that can occur and damage the tab 16. Unfortunately, many users find these difficult to use as the wings make it difficult to access the tab from certain angles and some individuals find it hard to fit their finger in between the wings in order to press on the tab to disengage the plug from the receptacle.

There is a need for an improved electrical connector capable of protecting a tab of the connector while allowing for easy actuation of the tab by a user.

SUMMARY OF THE INVENTION

In view of the above discussion, a snagless boot for an electrical connector with a locking tab such as a RJ45 connector is provided. According to one exemplary embodiment of the present invention, a boot for supporting a plug connected to a cable, the plug including a flexible tab attached thereto, comprising a housing having a front opening for accommodating the plug and an opposite back opening for receiving the cable and allowing the cable to pass therethrough to the plug, a recess formed in the housing; and a tab protector engaged with the recess for engaging the flexible tab of the plug is provided.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
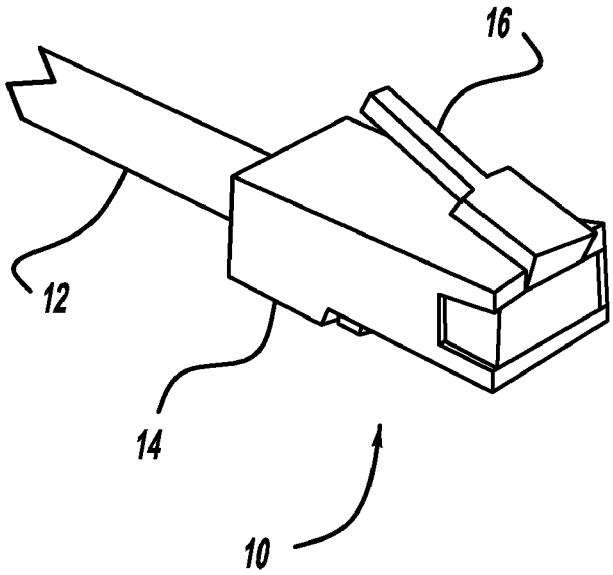
FIG - 1 Prior Art
FIG. 1 is a perspective view of a plug connector of the prior art.
Figure 2:
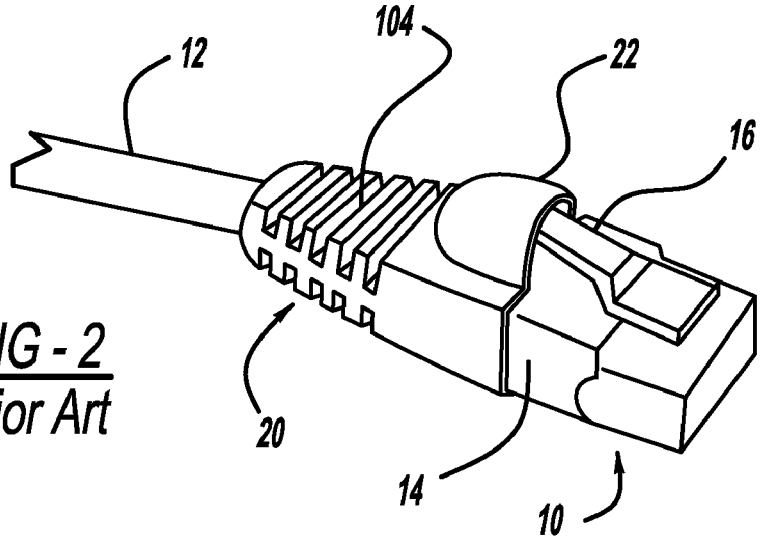
FIG - 2 Prior Art
FIG. 2 is a perspective view of a plug connector and boot of the prior art.
Figure 3:
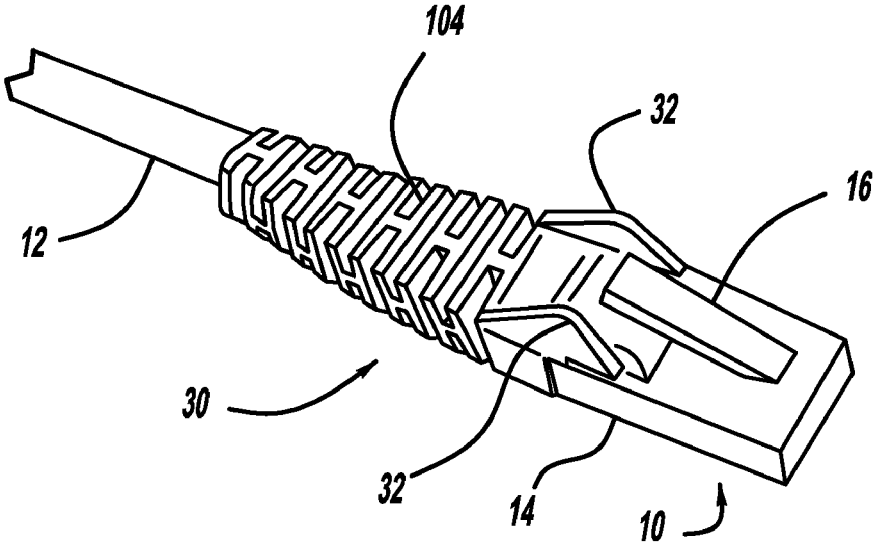
FIG - 3 Prior Art
FIG. 3 is a perspective view of a plug connector and boot of the prior art.
Figure 4:
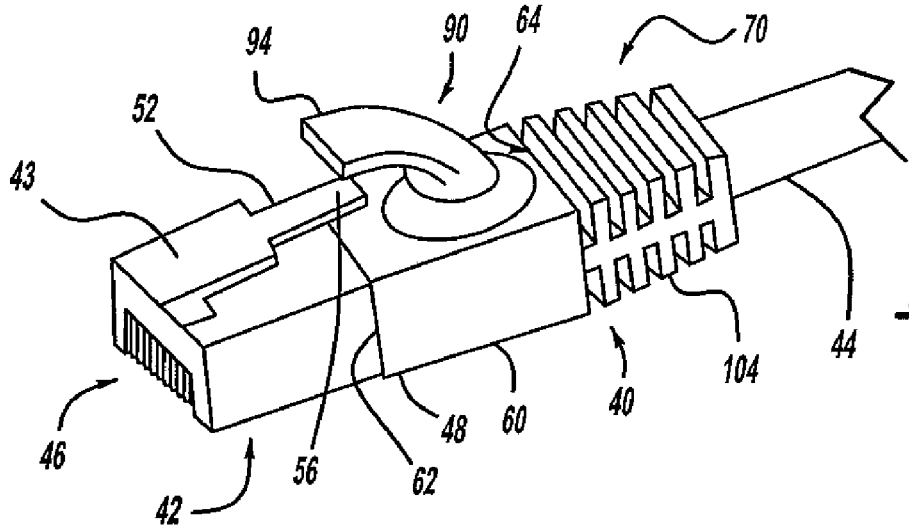
FIG. 4 is a perspective view of the preferred embodiment of the present invention.

Referring to FIG. 4, the preferred embodiment of the present invention is a boot 40 for supporting a plug 42 that is attached to a cable 44. The exemplary plug 42 is comprised of a main body 43 having an electrical end 46 for engaging with electrical connectors in a receptacle (not shown) and a substantially rectangular cable end 48. The cable end 48 has an opening (not shown) for receiving a portion of the cable 44 or at least the wires or other communication means therein. The opening can be large enough to accept the cable 44 and any insulation or outer layer of the cable. The opposite electrical end 46 includes a plurality of electrical contacts 50. The exposed ends of the wires within the cable 44 are connected to or placed in contact with the electrical contacts 50 which are used to provide electrical connections to the electrical contacts (not shown) of a communications receptacle (not shown). The plug 42 further includes a locking tab 52 extending out from the main body 43, preferably in an angular direction from the main body 43. The locking tab 52 is attached to the main body 43 at a flex point 54 and has a distal end 56 preferably extending towards the cable end 48 of the plug 42. The flex point 54 allows the distal end 56 of the locking tab 52 to be flexed toward the main body 43 of the plug 42 during the insertion and retraction of the plug 42 from a receptacle.

The boot 40 has a housing 60 preferably having four walls forming a plug end 62 and an opposite back end 64. The plug end 62 of the boot 40 is shaped such that the boot 40 attaches to said cable end 48 of the plug 42. The opposite back end 64 of the boot 40 includes an opening (not shown) of sufficient dimension to allow an end of the cable 44 to pass through. This opening also allows the boot 40 to be placed at least partially over the cable 44 and slid into an operable position against the plug 42. The four walls of the housing 60 form a substantially rectangular opening at the plug end 62 of sufficient dimension to allow an appropriate plug 42 to slide into the interior of the boot 40. One skilled in the art will appreciate that many modifications of the boot 40 are possible and the description of the boot 40 herein is not meant to limit the present disclosure. As an example of such a modification, the plug end 62 may be shaped and sized so as to also receive and cover a portion of the plug 42 (not shown).

The boot 40 preferably also includes a strain relief sleeve 70 as known and used in the art. The strain relief sleeve 70 can be integral with the housing 60 as shown in FIG. 4, or can be a separate piece (not shown) that is capable of being releasably connected to the housing 60 and/or the plug 42. The strain relief sleeve 70 strengthens the connection between the cable 44 and the plug 42 and also allows for the cable to bend relative to the plug 42 and/or boot 40 without applying any appreciable bending force to either the plug 42 or the boot 40. The strain relief sleeve 70 can be any appropriate strain relief component known or used in the art, including a passage to receive the cable 44. The strain relief sleeve 70 also preferably has a plurality of ribs and/or grooves 104 on the external surface, which increases the flexibility of the sleeve 70 while maintaining the strength and the ability to absorb bending forces.

The boot 40 according to the preferred embodiment of the present invention further includes a recess 80 in the housing 60 that is preferably circular in shape. The present invention further includes a tab protector 90 for selectively protecting the locking tab 52 from damage due to snags and other obstacles. The tab protector 90 has a connector portion 92 that is shaped and sized to engage with the recess 80 in the housing 60. Preferably, the connector portion 92 is rotatably engaged with the recess 80 so as to allow the tab protector 90 to rotate relative to the housing 60. The tab protector 90 also has a protector arm 94 that extends from the connector portion 92. The protector arm 94 has a predefined length such that the protector arm 94 extends over the distal end 56 of the locking tab 52 in order to prevent the locking tab 52 from snagging on objects causing it to break. In the preferred embodiment of the invention, the tab protector 90 rotates 360 degrees about the recess 80 once engaged. This rotation allows for the protector arm 94 of the tab protector 90 to be rotated to a position that provides snag protection for the locking tab 52. The rotation allows for a user to rotate the tab protector 90 away from the locking tab 52 in order to have easy access and use of the locking tab 52 or whenever snag protection is not necessary or required. The protector arm 94 is also preferably curved in shape so as to lessen the chances of the protector arm being snagged or caught on an obstacle.

Figure 5:
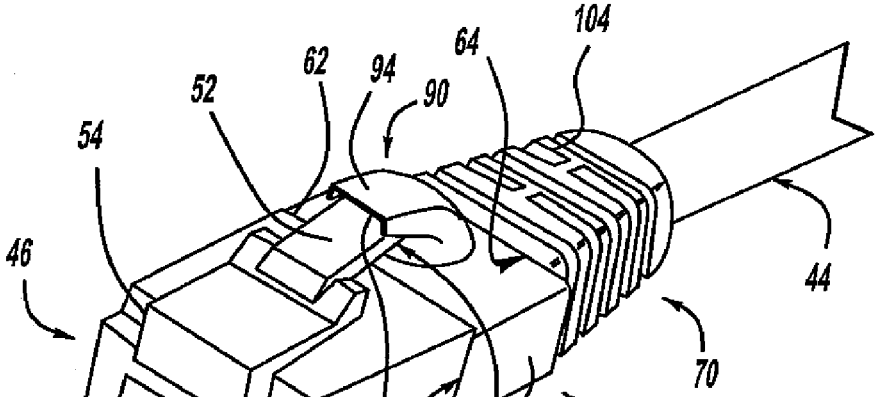
FIG. 5 is a perspective view of an alternate embodiment of the present invention.
Figure 6:
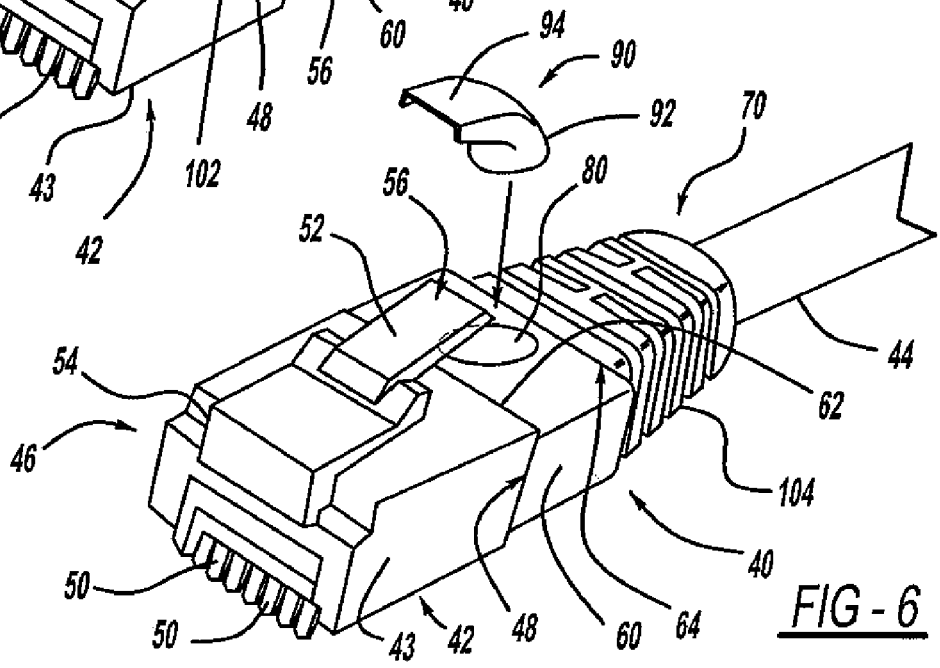
FIG. 6 is a partially exploded perspective view of the preferred embodiment of the present invention.
Figure 7:
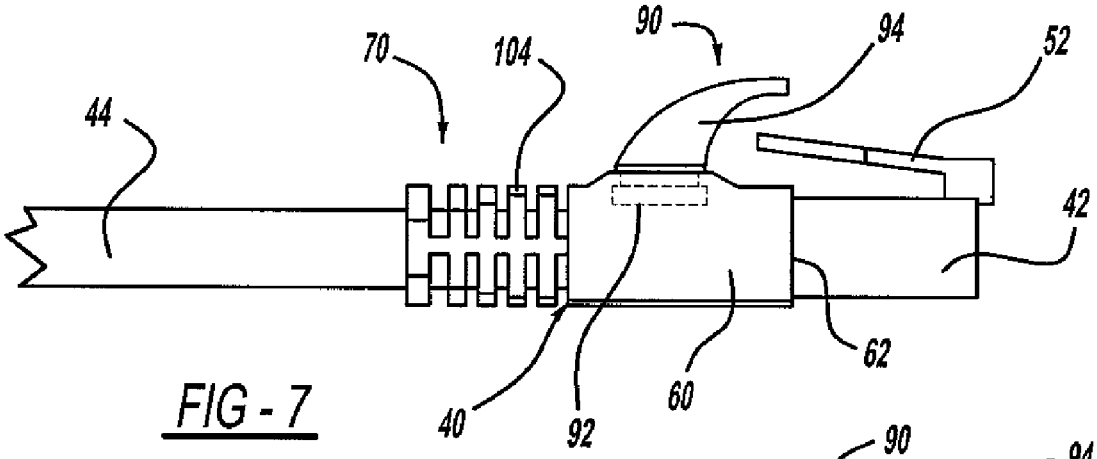
FIG. 7 is a side view of the preferred embodiment of the present invention.
Figure 8:
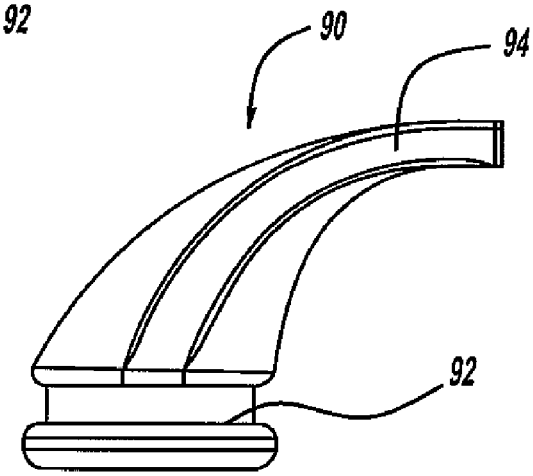
FIG. 8 is a side view of the tab protector in accordance with the preferred embodiment of the present invention.
Figure 9:
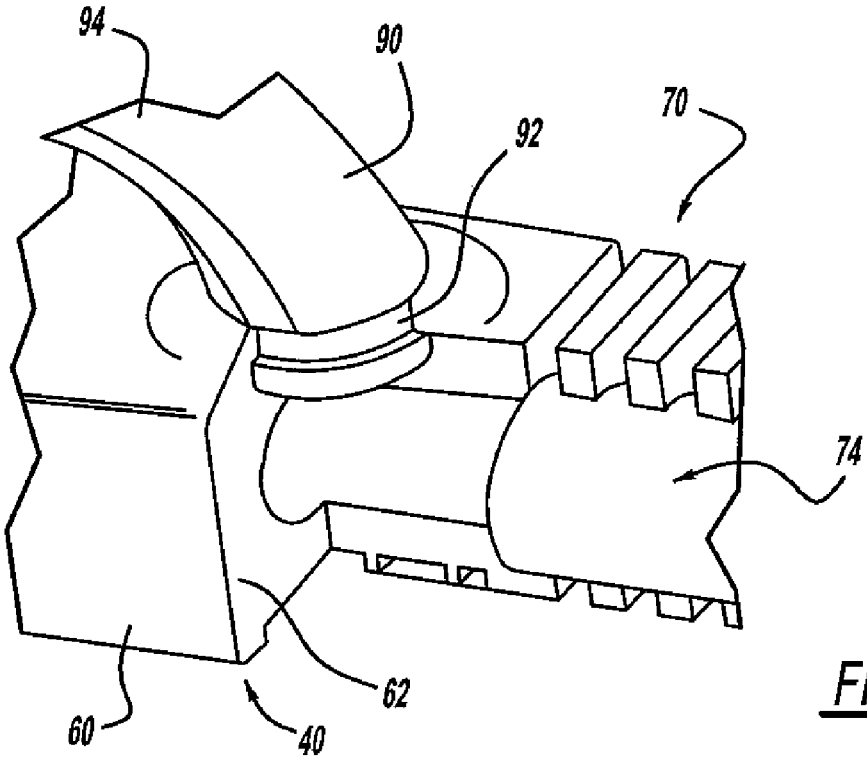
FIG. 9 is a view of the preferred embodiment of the present invention.
Figure 10:
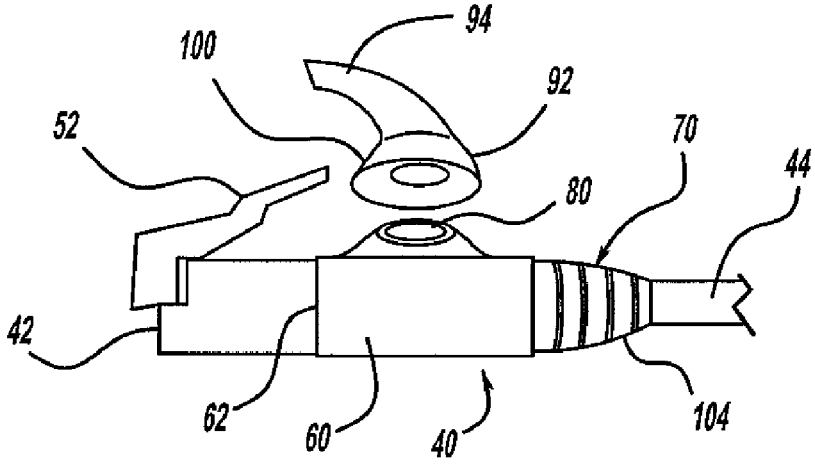
FIG. 10 is a perspective side view of an alternate embodiment of the present invention.
Figure 11A:
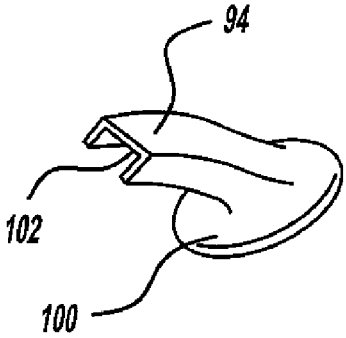
FIG. 11 is (a) perspective view and (b) a bottom view of the tab protector in accordance with another alternate embodiment of the present invention.
Figure 11B:
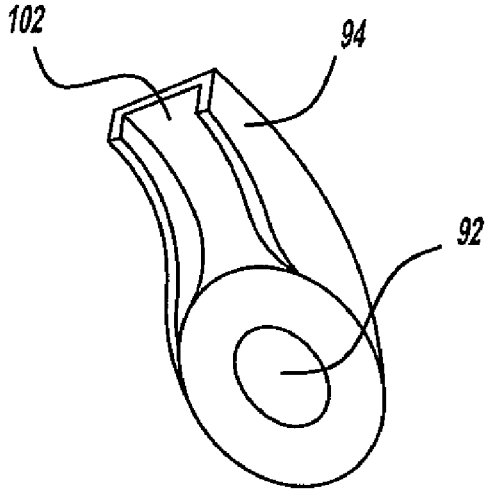

One skilled in the art will appreciate that the boot 40 and tab protector 90 as shown in the drawings are an example of the preferred embodiment only. For example, as a first alternate embodiment, the tab protector 90 could have a sleeve 100 over the connector portion 92 as shown in FIGS. 10 and 11 thereby covering the connection joint between the tab protector 90 and the housing 60 of the boot 40. As another example, in a second alternate embodiment, the protector arm 94 could have a channel 102 as shown in FIGS. 5 and 11 for accepting the locking tab 52 and thereby preventing the protector arm 94 from sliding away from the locking tab 52 once the locking tab 52 is releasably engaged with the protector arm 94. As one skilled in the art will realize, there arc numerous possible modifications that, while not specifically mentioned, are within the spirit and fall within the scope of this disclosure. For example, the tab protector 90 could be many different shapes and could be designed to be removable from the boot 40 or permanent. Other modifications may include connecting the tab protector 90 to a side wall of the housing 60 and/or changing the rotation or movement of the tab protector 90 relative to the housing 60, including limiting the rotation to less than 360 degrees.

Figure 12:
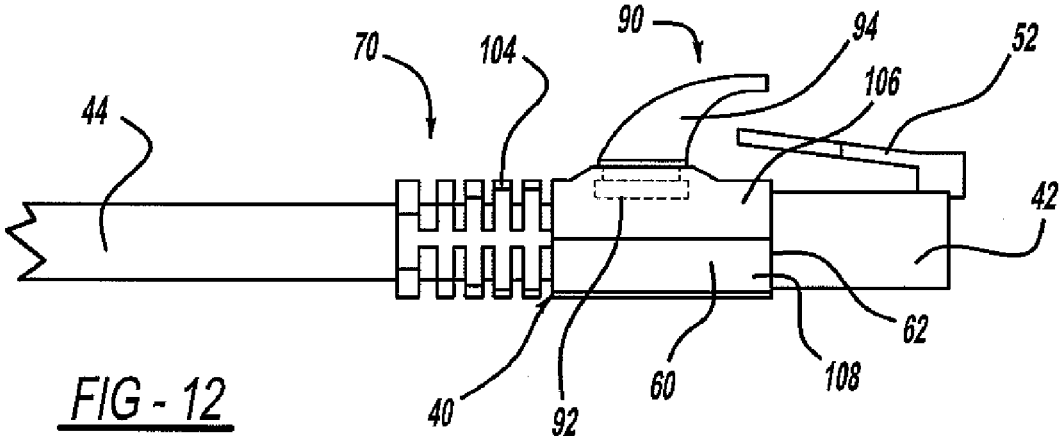
FIG. 12 is a side view of yet another alternate embodiment of the present invention.

In yet another alternate embodiment of the present invention, the boot 40 can be made of at least two separate portions, allowing the boot 40 to be attached to the plug 42 and/or cable 44 without having to slip the boot over an end of the cable 44 and/or remove the plug 42 from the cable for retrofit applications. For instance, referring to FIG. 12, a boot 40 (which can include an integrated strain relief component and/or actuator) can include a top half 106 and a bottom half 108 that are adhered, bolted, snapped together, screwed together, or otherwise connected to one another once in place relative to at least one of the cable 44 and the plug 42.

The boot 40 also can be colored, or can have a symbol or description formed therein, which can allow the attached cable to be identified relative to other cables and/or cords positioned around the connector.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A boot for supporting a plug connected to a cable, the plug including a flexible tab attached thereto, the boot comprising:

a housing having a front wall with a front opening for receiving the plug and an opposite back wall with a back opening for receiving the cable and an upper wall disposed between said front wall and said back wall, wherein the upper wall includes a recess; and a tab protector rotatably engaged within said housing recess that rotates along an axis that is perpendicular to said housing upper wall for selectively engaging the plug flexible tab, wherein said tab protector includes a connector portion and a protector arm extending upwardly from the connector portion.

2. The boot of claim 1 wherein said tab protector includes a substantially circular connector for connecting said tab protector with said boot and said connector portion is positioned adjacent a lower surface of said housing upper wall when engaged with said housing recess.

3. The boot of claim 1 wherein said tab protector arm is substantially curvilinear in shape, whereby said tab protector will resist catching on any adjacent objects.

4. The boot of claim 1 wherein the uppermost end of said tab protector arm includes a recess for engaging the flexible tab of the plug.

5. The boot of claim 1 wherein said tab protector is releasably engaged with said housing.

6. The boot of claim 1 further including a strain relief sleeve positioned adjacent said housing back wall for strengthening the connection between the cable and the plug.

7. The boot of claim 6 wherein said strain relief sleeve further includes a plurality of ribs for increasing the flexibility of said strain relief sleeve.

8. The boot of claim 1 wherein said housing is separable into a top half and a bottom half to facilitate placement of the boot over the plug and cable.

9. A connector for a communications cable comprising:

a plug having a body portion for receiving an end of the communications cable, said plug further having a flexible tab attached thereto and extending away from said body portion at an angle and having a distal end opposite the body portion;

a boot having a housing portion wherein said housing portion has front wall with a front opening for receiving said body portion of said plug, an opposite back wall with a back opening for receiving the communications cable therethrough, and an upper wall disposed between said front wall and said back wall, said upper wall having a recess formed therein;

a tab protector disposed within the recess in said boot upper wall whereby said tab protector includes a connector portion and a protector arm extending upwardly from the connector portion, and both the connector portion and protector arm rotate along an axis that is perpendicular to the housing upper wall to selectively engage or disengage with said distal end of said tab.

* * * * *